United States Patent [19]

Menegatto

[11] Patent Number: 4,955,552

[45] Date of Patent: Sep. 11, 1990

[54] YARN WINDING MACHINE

[76] Inventor: Carlo Menegatto, Via Spreafico No. 3, Monza, Milano, Italy

[21] Appl. No.: 441,256

[22] Filed: Nov. 27, 1989

[30] Foreign Application Priority Data

Oct. 25, 1989 [IT] Italy ..... 22130 A/89

[51] Int. Cl.[5] ..... B65H 54/20; B65H 54/30

[52] U.S. Cl. ..... 242/35.5 R; 242/26.2; 242/43 R; 242/158 R; 242/158 B

[58] Field of Search ..... 242/35.5 R, 43 R, 158 R, 242/158 F, 158.1, 158.2, 158.3, 158.4 R, 158.4 A, 26.1, 26.2, 26.3, 158.5, 158 B

[56] References Cited

U.S. PATENT DOCUMENTS

| | | | |
|---|---|---|---|
| 193,106 | 7/1877 | Bancroft | 242/35.5 R |
| 338,631 | 3/1886 | Burnham | 242/35.5 R |
| 550,897 | 12/1895 | Rhoades | 242/35.5 R |
| 661,209 | 11/1900 | Duffy | 242/35.5 R |
| 1,026,604 | 5/1912 | Rhoades | 242/35.5 R |
| 1,477,525 | 12/1923 | Rhoades | 242/26.2 |
| 2,811,319 | 10/1957 | Bakker | 242/35.5 R |

*Primary Examiner*—Stanley N. Gilreath

*Attorney, Agent, or Firm*—Beveridge, DeGrandi & Weilacher

[57] ABSTRACT

A yarn winding machine comprising a plurality of rotatable vertical spindles arranged in a longitudinal alignment on a support frame; single yarn guide members for the yarn to be wound on the bobbin placed on each spindle, are provided on mobile support members operatively connected to respective reciprocating drive members.

8 Claims, 5 Drawing Sheets

YARN WINDING MACHINE

BACKGROUND OF THE INVENTION

This invention relates to yarn winding machines and the like, and in particular it refers to improved yarn guide support and drive systems, so as to improve working conditions and to simplify the construction of the yarn winding machines.

The winding machines currently in use essentially comprise a support frame provided with a plurality of spindles rotatably supported and longitudinally aligned on the two sides of the machine; the spindles are driven to rotate at the same time by a tangential belt drive system.

During spindle rotation, the yarn is wound and distributed on the bobbins of each individual spindle by yarn guide system supported by a vertically movable frame, which extends the full length of the winding machine.

Such a solution, which contemplates the use of a single frame for the support of all the yarn guides of the machine, involves notable constructional and functional problems, due to the increased complexity of the stucture and the limits consequent to the considerable weight of the yarn guide supporting frame, which must be guided and maintained in rapid reciprocating motion. The large size of the yarn guide frame, and the elastic deformations which it can undergo can also cause problems and defects in winding the yarn on the bobbins. Moreover, becausde of the difficulty in reciprocating the whole yarn guide support frame, the spindle rotation speed, and thus the productivity of the machine is consequently limited. All things considered, the yarn guide support and drive system of current bobbin winding machines is the element which strongly conditions the work capacity of the machine itself.

The object of this invention is to provide an improved yarn winding machine provided with an yarn guide system which allows the work speed of the machine to be increased considerably, while also ensuring regular winding and accurate distribution of the yarn on the individual bobbins.

A further object of this invention is to provide a winding machine as related above, by means of which it is possible to perform winding of yarn on the bobbins by causing the spindles to rotate at speeds at least two or three times greater than those currently used, thus increasing the productivity of the machine.

A further object of the invention is to provide a winding machine of simplified construction, in which the use of the common yarn guide support frame is completely eliminated and in which two superimposed bobbins may be disposed on a same spindle.

SUMMARY OF THE INVENTION

The above can be achieved by means of a winding machine according to the invention, of the type comprising a support frame for at least a first set of spindles rotatably supported and longitudinally aligned on said frame, the winding machine also comprising movable yarn guide members for the yarn to be wound onto at least one bobbin associated with each single spindle, and drive means for reciprocating said yarn guide members, each yarn guide member being provided on a respective slidable support element, and an independent guide means, for said slidable support element, said guide means being arranged parallel on one side of a spindle, each yarn guide support element is operatively connected to a reciprocable drive means.

BRIEF DESCRIPTION OF THE DRAWINGS

Some preferred embodiments of a winding machine according to this invention will be described hereunder, with reference to the accompanying drawings, in which.

DESCRIPTION OF THE INVENTION

Figure 1:
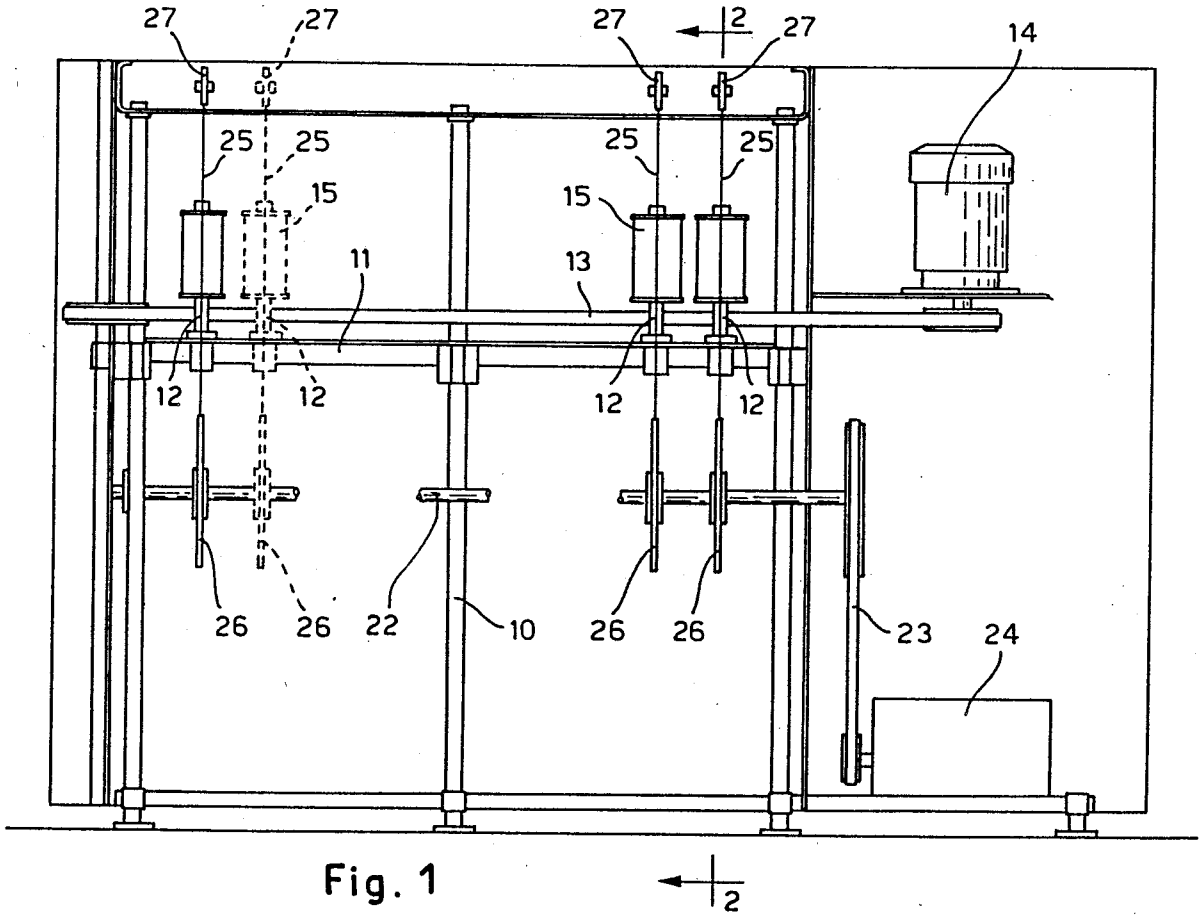
FIG. 1 is a front view of a yarn winding machine according to a first embodiment of the invention.

With reference to FIGS. 1 to 4, we will describe a first embodiment of a yarn winding machine according to the invention, capable of allowing very high work speeds as a consequence of the reduced mass of the reciprocating yarn guides.

The winding machine essentially comprises a structure 10 for the support of a spindle-holding frame 11 provided with two rows of vertical spindles 12, rotatably supported and longitudinally aligned on the two sides of the machine. The spindles 12 on the two sides are driven to rotate simultaneously by means of a tangential drive system comprising an endless belt 13 powered by a motor 14. 15 indicates the bobbins for winding the yarn 16, on each individual spindle 12, which is unwound from an underlying reel 17 having greater dimensions.

The yarn 16, which unwinds from reel 17, passes through a yarn tightener 18 which acts to maintain the yarn at the required winding tension, then yarn 16 passes through an yarn guide member 19 whose function is to uniformly and alternately distribute the yarn along the whole height of bobbin 15, during winding up.

Figure 2:
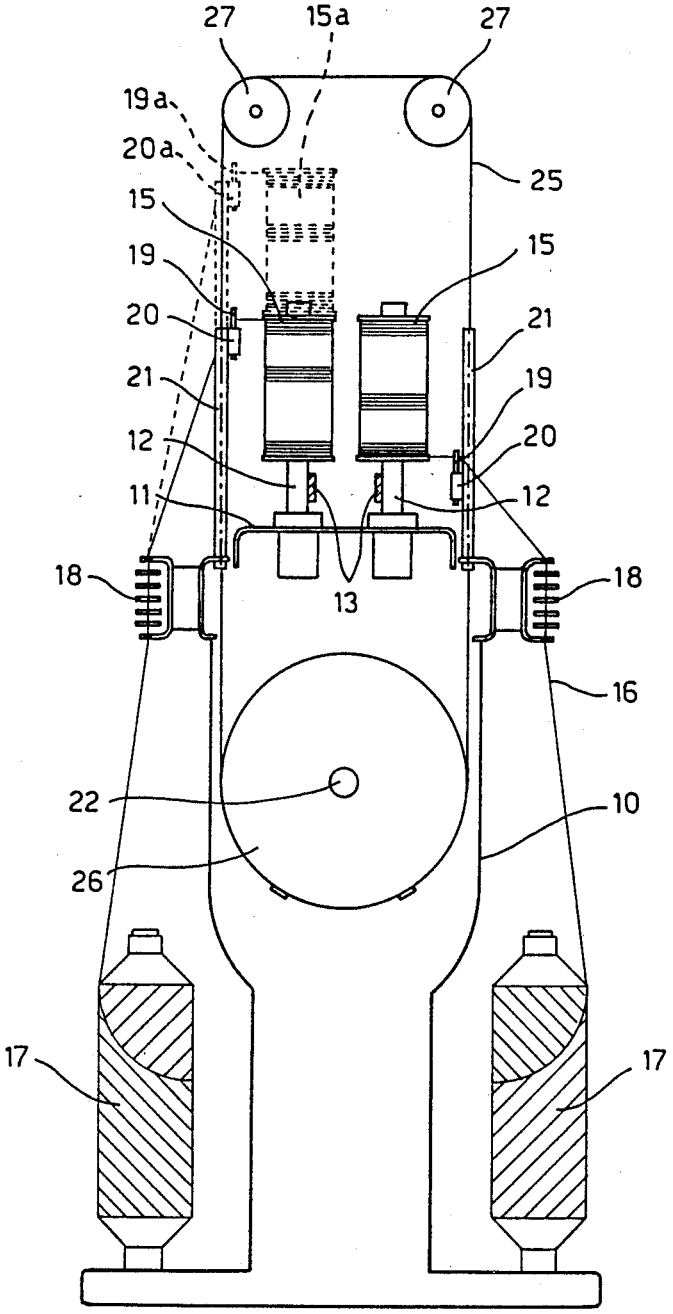
FIG. 2 is a cross-sectional view along line 2—2 of FIG. 1.

According to this invention there is provided an independent, yarn guide member 19 individually driven for each spindle 12 fo the machine, or driven in pairs for counterposed spindles on the two sides of the machine as shown in FIG. 2.

In particular, in the case of this first embodiment of the invention, each yarn guide member 19 is attached to a respective movable support element 20 which runs along a vertical guide 21 arranged parallel to the respective spindle 12 on the outer side of frame 10 of the machine.

Each movable support element 20 of the yarn guide 19 is in turn connected to a reciprocating drive system by means of single drive connected to a common drive shaft 22; the shaft 22 stretches the entire length of the winding machine underneath spindle-holding frame 11. The shaft 22 is in turn connected by a transmission gear 23 to a drive mechanism 24 which determines a reciprocating rotation for an angle of predetermined amplitude, sufficient to cause the yarn guide member 19 to perform the entire working stroke.

In particular, as shown in FIG. 2, the support elements 20 of each pair of spindles 12 on the two opposing sides of the machine are connected to a common transmission element such as, for example, a cable 25, a toothed belt or other equivalent annular drive element, which winds round a respective central pulley 26 connected to the reciprocating shaft 22, and on transmission wheels 27; in the case of FIG. 2 the transmission wheels 27 are placed above the spindle-holding frame 11 in such a way that each drive element 25 surrounds the spindles themselves. This solution, which develops vertically, above spindles 12, is extremely advantageous in that it reduces to a minimum the masses in movement with alternate motion, and particularly the mass of each yarn guide support element 20.

Figure 3:
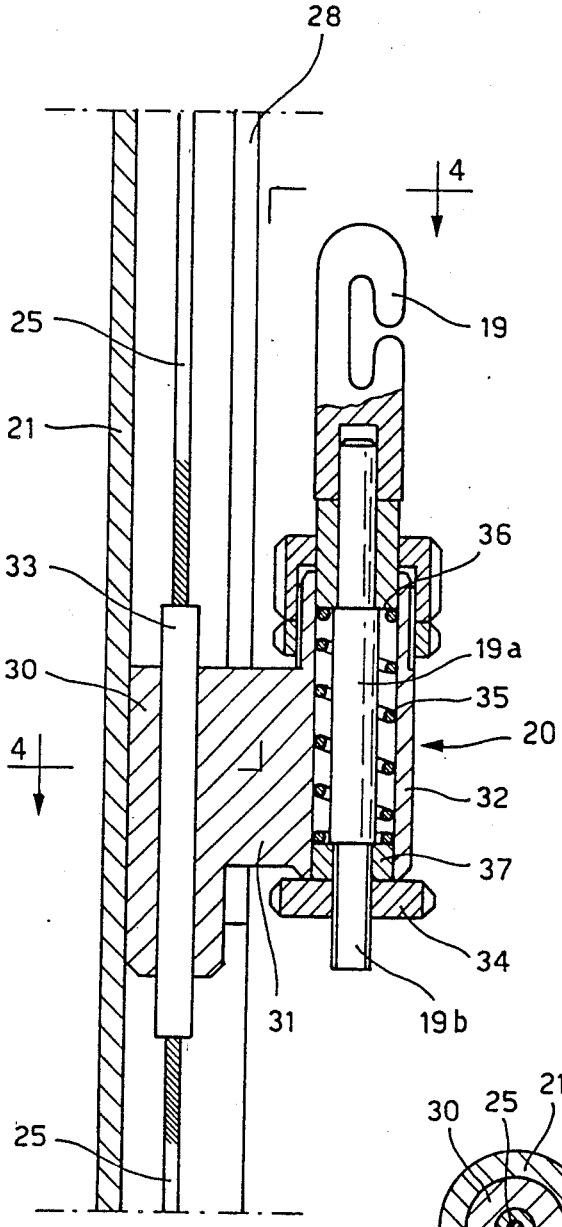
FIG. 3 is an enlarged detail of a yarn guide of the winding machine according to the preceding figures.
Figure 4:
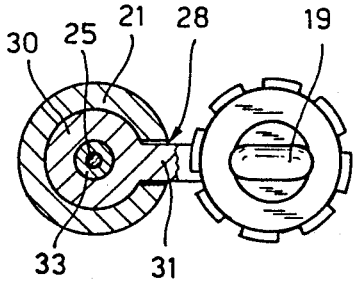
FIG. 4 is a transverse section along line 4—4 of FIG. 3.

Each support element 20 for the yarn guide 19, and thus the guide member itself, can have a different conformation; for example, as shown in FIGS. 3 and 4 the vertical guide 21 for the yarn guide is in the form of a tubular element having a longitudinal slit 28 on the side facing spindle 12.

The support element 20 for the yarn guide 19 in turn comprises a slider 30 sliding inside the tube member 21; an arm 31 protrudes externally through the slit 28 of the tube termination in a bush 32 into which the stem 19*a* of an yarn guide member 19 is inserted and supported in an axially adjustable way. The slider 30 of the yarn guide support member 20 is suitably attached to the cable 25 or an equivalent drive element by means of a joining element 33 to which are attached the two ends of cable 25, which are forced into an axial hole in the abovementioned slider 30.

So as to allow the position of the yarn guide member 19 to be axially adjusted according to the solution shown in FIG. 3, the yarn guide member 19 has a shank 19*a* which extends inside the tubular part 32 of the support element 20; the shank 19*a* protrudes below with a threaded portion 19*b* onto which a threaded nut 34 or equivalent adjusting element is screwed. A counteracting spring 35 is disposed inside tubular part 32 of the yarn guide support resting against a shoulder 36 and respectively against a shoulder 37 at the opposite ends. Thus by turning the nut 34 to a greater or lesser extent the height position of the yarn guide member 19 can be finely adjusted.

It is evident that the solution shown in FIG. 3 has a been provided solely as an example, and that the guide tube 21 could be replaced by a polygonally sectioned rod, providing the support element 20 with a suitable bush to slide along the rod itself.

The example shown in FIGS. 1 and 2 shows a first solution whereby the individual elements for transmitting the reciprocating motion to the yarn guides 19 of each pair of spindles on opposite sides of the machine extend above the spindles themselves so as to minimize the reciprocating masses of the movable yarn guide support elements.

Figure 5:
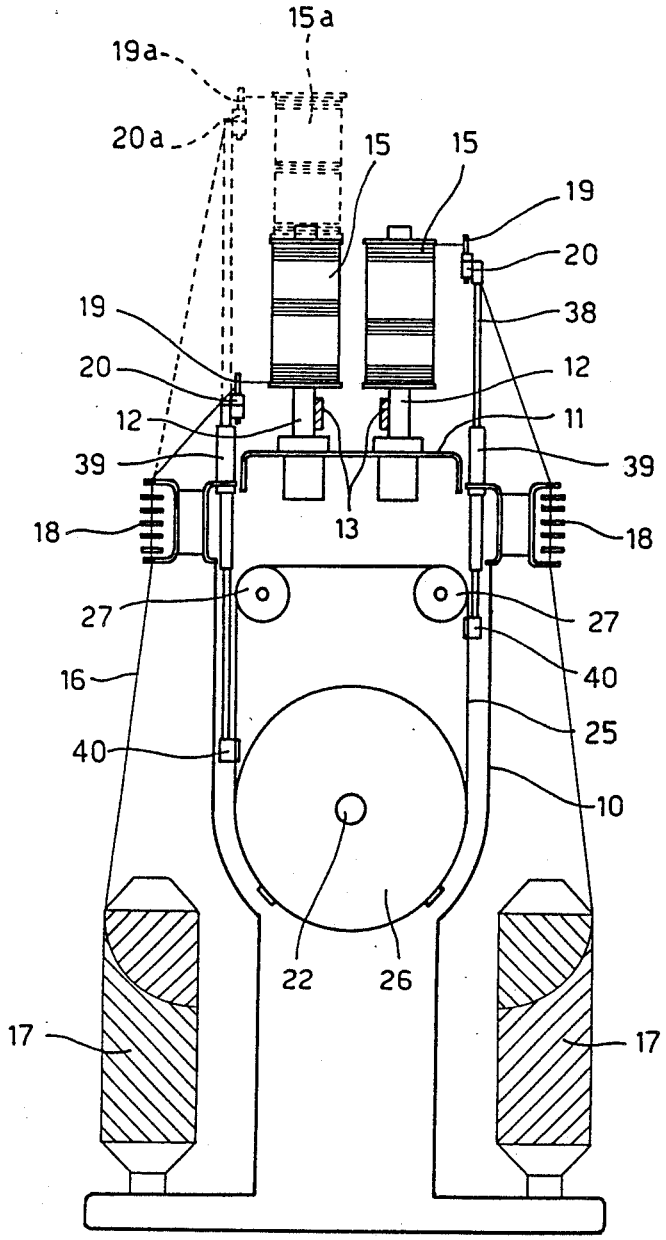
FIG. 5 is a cross-sectional view of the winding machine, similar to that of FIG. 2, relating to a second embodiment of the invention.
Figure 6:
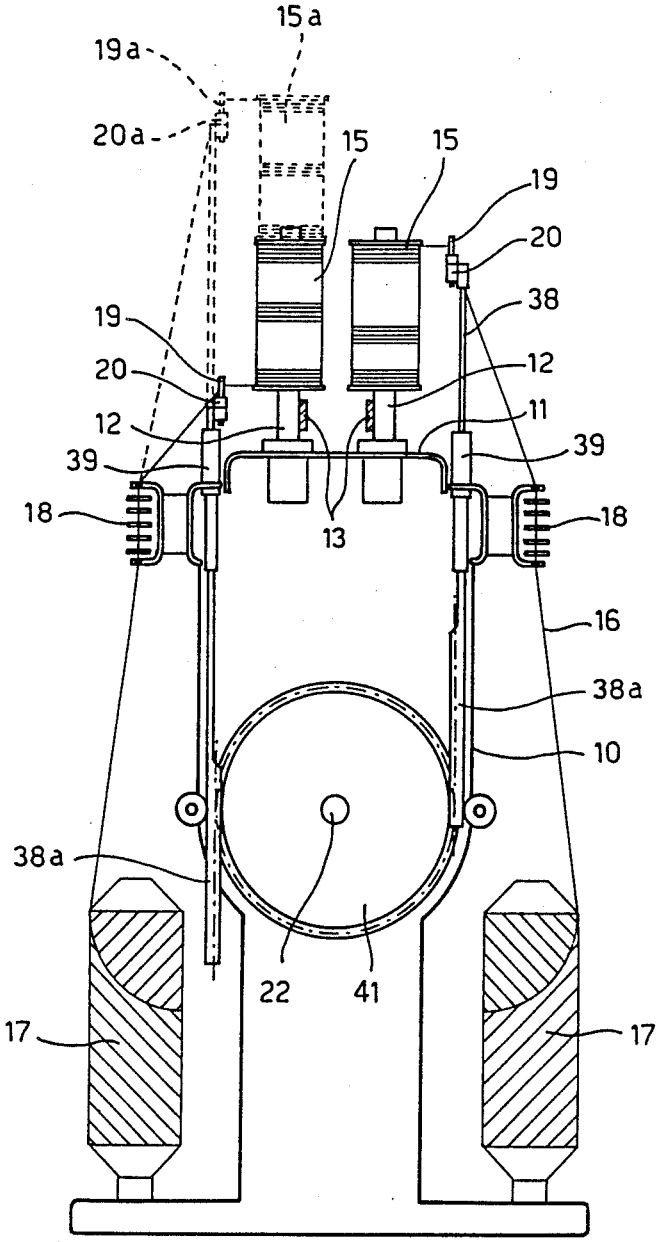
FIG. 6 is a view similar to the preceding FIGS. 2 and 5, for a third embodiment of the invention.

FIGS. 5 and 6 of the accompanying drawings, however, show other solutions which, alternatively, allow the height dimensions of the winding machine to be reduced, although maintaining the same innovative principle of this invention; thus in FIGS. 5 and 6 parts similar or equivalent to those of the preceding figures have been indicated by the same reference numbers.

The example in FIG. 5 differs from that of FIG. 2 mainly for the fact that each yarn guide element 19 is fixed to or extends downwards with a stem 38 sliding inside a guide sleeve 39 fixed laterally to the machine structure 10.

Each stem 38 is of sufficient length, and the sleeve 39 itself is positioned in such a way as to allow the yarn guide its full working stroke. Stem 38 extending towards the bottom of the guide sleeve 39 is in turn fixed, by means of a clamp 40, to the cable 25 which winds on the central pulley 26 and on the transmission pulleys 27; in this specific case the pulleys 27 are positioned below the spindle-holding frame 11. The resulting support and drive system for the yarn guide 19 is of extremely reduced bulk, although still allowing high work speeds.

A third solution is shown in FIG. 6, in which the same reference numbers have been used to indicate similar or equivalent parts; the cable drive system has been replaced by a rack drive system envisaging, for example, a central toothed wheel 41 in place of the central pulley 26, which engages with rack extensions 38*a* of the rods 38 associated with each support element 20 of the yarn guide member 19. It is, however, evident that, in place of the single central toothed wheel 41, independent toothed wheels could be provided for each rack, appropriately connected to a reciprocating drive shaft common to the yarn guides on both sides of the machine, or to separate or independent drive shafts fro each set or yarn guides fitted on a respective side of the winding machine. While in the first case, and according to the examples given here, the yarn guides 19 on one side of the machine are driven in such a way as to move in the opposite direction to yarn guides 19 which are on the opposite side, in the latter case the yarn guides 19 on both sides could also move at the same time and in the same direction.

FIGS. 2, 5 and 6 also show a further alternative whereby two bobbins 15, 15*a* could be wound at the same time on a same spindle 12, providing, in this case, two axially aligned yarn guide members 19 and 19*a* having their support elements 20 and 20*a* guided by the same tubular guide element 21 which extends upwards, as indicated by the dotted line, and in which both support elements 20 and 20*a* for the yarn guides of the same spindle are connected to the same side of the cable or drive member 25 or 38.

In all cases a winding machine has been provided having an extremely simplified support system for the yarn guides 19 with greatly reduced masses in alternate motion, capable of allowing high work speeds.

What is claimed is:

1. A yarn winding machine of the type comprising a spindle-holding frame for at least a first set of spindles rotatably supported and longitudinally aligned on said frame, the winding machine also comprising movable yarn guide members for the yarn to be wound onto at least one bobbin associated with each single spindle, and drive means for reciprocating said yarn guide members, each yarn guide member being provided on a respective slidable support element, a separate guide means for each said slidable support element, each said guide means being arranged parallel to and on one side of a respective spindle and a reciprocable drive means operatively connected to each yarn guide support element.

2. A yarn winding machine as in claim 1, of the type comprising a first set and respectively a second set of spindles longitudinally aligned on opposing sides of the machine, whereby each spindle on one side is counterposed to a spindle on the other side, wherein said drive means includes means for operatively connecting the drive means for the yarn guide support element of a spingle of the first set of spingles to the yarn guide support element of an opposing spindle of the second set of spindles.

3. A yarn winding machine as in the preceding claim 2, in which said drive means comprises an annular drive element, such as a cable, belt or the like.

4. A yarn winding machine as in claim 3, in which said annular drive element extends upwards from a reciprocating drive member positioned underneath the spindleholding frame of the machine tie a position above the spindles themselves, each slidable support element for the yarn guides being directly connected to the said drive element.

5. A yarn winding machine as in claim 3, in which said annular drive element extends from a reciprocable drive element, towards and under the spindleholding frame, and in which each yarn guide support element comprises a rod sliding in a tubular guide element, one end of said rod being operatively connected to the above-mentioned drive element.

6. A yarn winding machine as in claim 1, in which said slidable support element comprises a rod sliding in a guide sleeve, and said drive means includes a reciprocating drive member and a rack operatively connecting said rod and said drive member.

7. A yarn winding machine as in claim 1, in which each said support element is provided with means to axially adjust the position of the yarn guide member provided thereon.

8. A yarn winding machine as in claim 1, wherein each siad spindle includes axially aligned first and second bobbins, a respective yarn guide member and slidable support element being provided for each bobbin, and the support elements of the yarn guide members for said bobbins on each spindle being connected to the same drive means.

* * * * *